US007845646B1

(12) United States Patent
Weber

(10) Patent No.: US 7,845,646 B1
(45) Date of Patent: Dec. 7, 2010

(54) PRACTICE TARGETING SYSTEM AND METHOD OF USE THEREOF

(76) Inventor: Thomas J. Weber, 305 S. Vermont St., Cortland, NE (US) 68331

( * ) Notice: Subject to any disclaimer, the term of this patent is extended or adjusted under 35 U.S.C. 154(b) by 0 days.

(21) Appl. No.: 11/977,478

(22) Filed: Oct. 25, 2007

Related U.S. Application Data

(60) Provisional application No. 60/854,002, filed on Oct. 25, 2006.

(51) Int. Cl.
*F41J 1/10* (2006.01)

(52) U.S. Cl. ..... 273/407

(58) Field of Classification Search ..... 273/403–410, 273/390–392

See application file for complete search history.

(56) References Cited

U.S. PATENT DOCUMENTS

| | | | | | |
|---|---|---|---|---|---|
| 574,087 | A | * | 12/1896 | Frick | 273/402 |
| 2,048,155 | A | * | 7/1936 | Armantrout | 273/407 |
| 2,372,111 | A | * | 3/1945 | Norberg | 273/407 |
| 2,538,118 | A | * | 1/1951 | Miller | 273/407 |
| 2,722,420 | A | * | 11/1955 | Adamson | 273/407 |
| 3,355,174 | A | * | 11/1967 | Hutson | 273/408 |
| 3,540,729 | A | * | 11/1970 | Rahberger | 273/407 |
| 3,601,353 | A | * | 8/1971 | Dale | 248/470 |
| 4,913,389 | A | | 4/1990 | McCracken | |
| 5,067,683 | A | | 11/1991 | Wager | |
| 5,169,157 | A | | 12/1992 | Salmon | |
| 5,598,996 | A | * | 2/1997 | Rath | 248/163.1 |
| 5,671,924 | A | * | 9/1997 | Scott | 273/407 |
| 5,829,753 | A | | 11/1998 | Wiser | |
| 5,860,654 | A | * | 1/1999 | Jacobs | 273/407 |
| 5,938,203 | A | | 8/1999 | Beckwith, Sr. | |
| 5,947,477 | A | * | 9/1999 | Turnipseed | 273/407 |
| 5,967,523 | A | | 10/1999 | Brownlee | |
| D424,652 | S | | 5/2000 | Minneman | |
| 6,726,208 | B2 | | 4/2004 | Wilkus | |
| 6,761,357 | B2 | * | 7/2004 | Witt et al. | 273/407 |
| 6,808,177 | B2 | | 10/2004 | Dehart | |
| 6,913,263 | B2 | | 7/2005 | Fort, II | |
| 7,052,012 | B2 | | 5/2006 | Dehart | |
| 7,338,048 | B1 | * | 3/2008 | Hulstine | 273/407 |
| 7,374,173 | B2 | * | 5/2008 | Nasuti | 273/407 |
| 2006/0220318 | A1 | * | 10/2006 | Law | 273/407 |
| 2009/0079136 | A1 | * | 3/2009 | Shalosky | 273/407 |

* cited by examiner

*Primary Examiner*—Mark S Graham
(74) *Attorney, Agent, or Firm*—Montgomery Patent and Design; Robert C. Montgomery

(57) ABSTRACT

A system that holds clay targets for the purposes of target practice which comprises interchangeable single and double tier target holders for holding clay targets, paper targets, or swinging metal targets is herein disclosed. The target holders are approximately forty-eight (48) inches in length and are connected at each end to a vertical tube which slides over a steel leg post that is subsequently inserted securely into a grade surface. The leg posts are approximately forty-eight (48) inches in height and are provided with a foot peg to aid in the grade surface insertion process. The double tiered target holders are particularly designed for clay pigeon targets and comprise channels lined with self-adhesive felt strips to aid in keeping the clay pigeon targets in position and prevent sliding. The invention is envisioned to be utilized with small caliber handguns and rifles such as BB guns, pellet rifles, .22 caliber rifles, and the like.

5 Claims, 4 Drawing Sheets

PRACTICE TARGETING SYSTEM AND METHOD OF USE THEREOF

RELATED APPLICATIONS

The present invention was first described in and claims the benefit of U.S. Provisional Patent Application No. 60/854,002 filed on Oct. 25, 2006, the entire disclosures of which are incorporated herein by reference.

FIELD OF THE INVENTION

The present invention relates generally to a system for immediate response for handgun target shooting and, more particularly, to an apparatus that holds clay targets for the purposes of target practice.

BACKGROUND OF THE INVENTION

Target shooters often have trouble locating suitable targets. Most target systems use paper based targets, which while accurate for determining shot placement, take time to determine results and do not provide immediate gratification. In small arms practice, it is important to have a number of targets ready for use at any one time. Many utilize bottles, cans or other similar items paced on a fence rail or other structure that result in property damage and litter. Traditional practice devices for clay targets do not offer this capability. A permanent structure on a shooting range can be built, but may hinder other types of target shooting. A training aid should be portable and easy to set-up for use either at a range or other outdoor location. Accordingly, there exists a need for an effective training aid which provides immediate feedback for target shooting without the disadvantages as described above. The development of the invention herein described fulfills this need.

Several attempts have been made in the past to provide a means to hold and secure a plurality of targets, particularly for the purposes of target practicing. U.S. Pat. No. 7,052,012 issued to Dehart discloses a target system. This device does not appear to disclose an apparatus capable of maintaining clay targets in a stationary position for target shooting, nor does this device permit the placement of targets off of the ground.

U.S. Pat. No. 6,913,263 issued to Fort discloses a target holding device. This device does not appear to disclose an apparatus capable for maintaining a plurality of clay targets in a horizontal position for target shooting.

U.S. Pat. No. 6,808,177 issued to Dehart discloses a target system. This device does not appear to disclose an apparatus capable of maintaining clay targets in a stationary position for target shooting.

U.S. Pat. No. 6,726,208 issued to Wilkus discloses a stand for targets. This device does not appear to disclose an apparatus capable for maintaining a plurality of clay targets in a horizontal position for target shooting.

U.S. Pat. No. 5,967,523 issued to Brownlee discloses a target stand. This apparatus does not appear to disclose an apparatus capable for maintaining a plurality of clay targets in a horizontal position for target shooting.

U.S. Pat. No. 5,938,203 issued to Beckwith discloses a portable target stand and target. This device does not appear to disclose an apparatus capable for maintaining a plurality of clay targets in a horizontal position for target shooting.

U.S. Pat. No. 5,829,753 issued to Wiser discloses a multifunctional portable target stand and dispenser. This device does not appear to disclose an apparatus capable for maintaining a plurality of clay targets in a horizontal position for target shooting.

U.S. Pat. No. 5,169,157 issued to Salmon discloses a target holder. This device does not appear to disclose an apparatus capable for maintaining a plurality of clay targets in a horizontal position for target shooting.

U.S. Pat. No. 5,067,683 issued to Wager discloses a portable target holder. This device does not appear to disclose an apparatus capable for maintaining a plurality of clay targets in a horizontal position for target shooting.

U.S. Pat. No. 4,913,389 issued to McCracken discloses a unitary target stand. This device does not appear to disclose an apparatus capable for maintaining a plurality of clay targets in a horizontal position for target shooting.

SUMMARY OF THE INVENTION

In view of the foregoing disadvantages inherent in the prior art, it has been observed that there is need for an apparatus that horizontally holds a plurality of clay targets for the purposes of target practice.

The practice targeting system provides a convenient, easy to use training aid for target practice.

The practice targeting system is comprised of non-corrosive metals with an anti-corrosion finish which provide a strong and durable structure for repeated use.

The practice targeting system comprises two interconnected channels for holding up to ten clay targets apiece with approximate spacing of two (2) inches in between each target. The channels are approximately forty-eight (48) inches in length and spaced approximately ten (10) inches apart and are connected at each end to a tube.

The practice targeting system is inserted into the ground utilizing steel rods that have attached footrest to aid in the earth insertion process.

The practice targeting system is portable and easy to set up for use.

The practice targeting system possesses self-adhesive felt strips in each of the channels to maintain the targets in their position and prevent sliding.

The practice targeting system may be used with any small caliber firearm such as, but not limited to, handguns and rifles, BB guns and pellet rifles.

The practice targeting system anticipates the use of clay targets, however the system also accommodates paper targets, spinners and other targets.

The practice targeting system, in an alternative embodiment, possesses a single beam for supporting a plurality of targets.

The prior art discloses devices which provide devices designed to hold targets for target shooting. The prior art does not appear to disclose an apparatus and a system for maintaining a plurality of clay targets in a horizontal position for target shooting.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
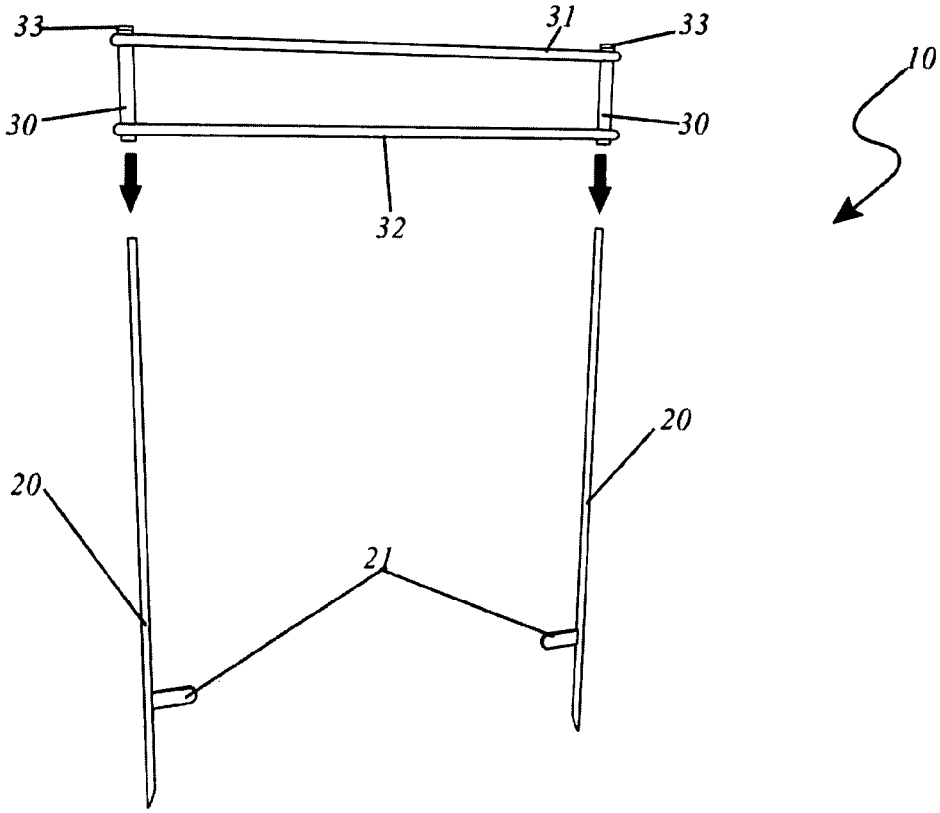
FIG. 1 is a front perspective view of a practice targeting system 10, according to a preferred embodiment of the present invention.

10 practice targeting system
20 leg post
21 foot peg
30 double-tiered tube
31 upper rail
32 lower rail
33 end cap
34 felt strip
35 stiffener bar
40 single-tiered tube
42 single-tiered beam
43 target bracket
44 target connector
45 swinging target
46 bulls-eye
47 retaining fastener
48 swinging motion
60 clay pigeon target
70 paper target
100 grade surface

DETAILED DESCRIPTION OF THE PREFERRED EMBODIMENT

The best mode for carrying out the invention is presented in terms of its preferred embodiment, herein depicted within FIGS. 1 through 3*c*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a system and method for a practice targeting system (herein described as the "system") 10, which provides a means for a system 10 which comprises target holders for marksmanship target practice comprising interchangeable single and double-tiered configurations holders for holding clay targets 60, paper targets 70, or swinging metal targets 45. The target holders are approximately forty-eight (48) inches in length and are connected at each end to a vertical tube 30 which slides over a steel leg post 20 that is subsequently inserted securely into a grade surface 100. The leg posts 20 are approximately forty-eight (48) inches in height and are provided with a foot peg 21 to aid in the grade surface 100 insertion process. The double-tiered target holders are particularly designed for supporting clay pigeon targets 60 and comprise channels lined with self-adhesive felt strips 34 to aid in keeping the clay pigeon targets 60 in position and prevent sliding. The invention 10 is envisioned to be utilized with small caliber handguns and rifles.

Figure 1A:
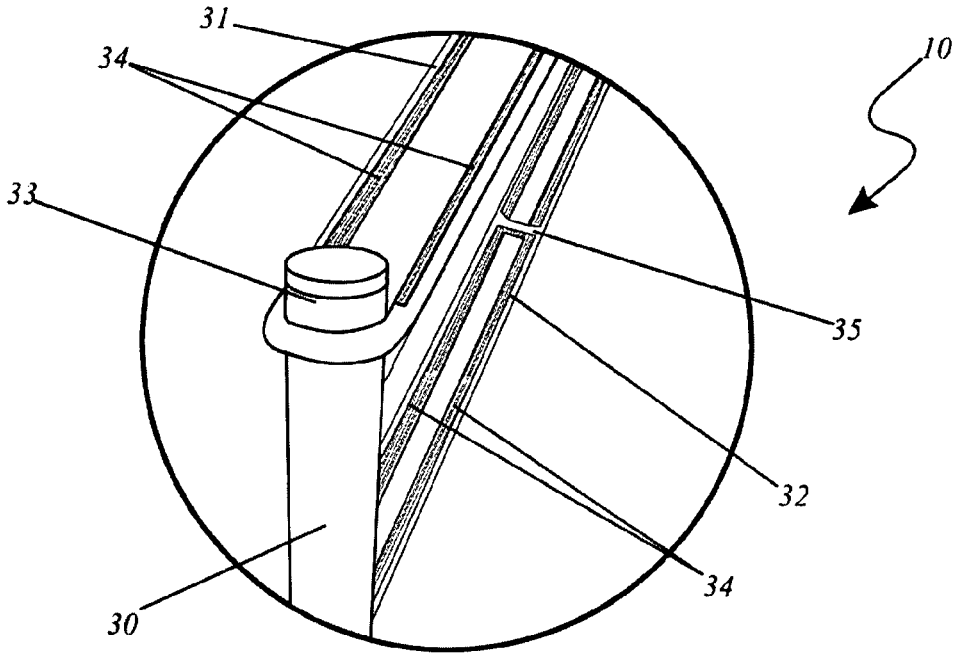
FIG. 1*a* is a close-up perspective view of a rail portion 31 of a practice targeting system 10, according to a preferred embodiment of the present invention.

Referring now to FIGS. 1 and 1*a*, front perspective and close-up views of the system 10, according to the preferred embodiment of the present invention, are disclosed. The system 10 is illustrated here with a double-tiered target holding configuration. A plurality of targets such as clay pigeon targets 60, paper targets 70, or the like may be utilized by a user during normal target practice. Upon striking said targets 60, 70 with a bullet or pellet projectile, the user is providing immediate visual marksmanship accuracy and consistency feedback. The system 10 comprises a pair of leg posts 20 and a double-tiered target holder further comprising a pair of double-tiered tubes 30, an upper rail 31, a lower rail 32, a pair of end caps 33, and a plurality of felt strips 34. The system 10 is envisioned to be utilized with small caliber handguns and rifles such as, but not limited to, BB guns, pellet rifles, .22 caliber rifles, and the like. The system 10 as illustrated here is particularly designed to hold two (2) rows of clay pigeon targets 60 for the purposes of small caliber target practice. The upper 31 and lower 32 rails take the form of two interconnected beams or rails which hold a plurality of clay pigeon targets 60. The rails 31, 32 are approximately forty-eight (48) inches in length and are approximately ten (10) inches apart. Each rail 31, 32 comprises a parallel pair of round metal rods spaced approximately one (1) inch apart. To maintain a parallel relationship between said parallel rod portions, a plurality of perpendicular stiffener bars 35 are provided. The stiffener bars 35 are envisioned to be made using similar diameter and materials as the rails 31, 32 and affixed thereto using preferably a welding process. The interior surfaces of each rail 31, 32 comprise self-adhesive felt strips to aid in keeping the clay pigeon targets 60 in position and prevent sliding thereof. Each rail 31, 32 comprises end portions being circularly formed and wrapped around vertical double-tiered tubes 30. Said rails 31, 32 are envisioned to be affixed thereto said double-tiered tubes 30 using preferably a welding process. Each double-tiered tubes 30 comprises a circular end cap 33 being welded thereupon a top end portion thereof. Each double-tiered tube 30 further comprises an open bottom end portion having a particularly sized inside diameter so as to fit slidingly over respective leg posts 20. The leg posts 20 provide an attachment of the system 10 thereinto a grade surface 100. Each leg post 20 comprises a solid metal rod approximately forty-eight (48) inches in length and a foot peg 21 being affixed thereto approximately twelve (12) inches therefrom a bottom end thereon also being affixed thereto via a welding process. The foot peg 21 comprises a rectangular-shaped metal appendage extending approximately six (6) inches perpendicularly therefrom the leg post 20 providing an insertion aid thereto the leg post 20 by manually pressing one's foot downward upon said foot peg 21, thereby driving a leg post 20 into a grade surface 100. Each leg post 20 further comprises an angularly cut end portion to further aid in the grade surface 100 insertion process. Furthermore, paper targets 70 and similar target practice devices may be used by either spanning the two rails 31, 32 or hanging therefrom.

The materials required to produce the major components of the system 10 are envisioned to be made of non-corrosive, painted, or plated metals being suitable for extended outdoor use. The various shapes used to construct the system 10 such as the channel, tube and rod stock, would be manufactured in a rolling or extrusion process or other suitable process. The various elements of the system 10 are envisioned to be produced by cutting to length; and welding together in assembly jigs.

Figure 2A:
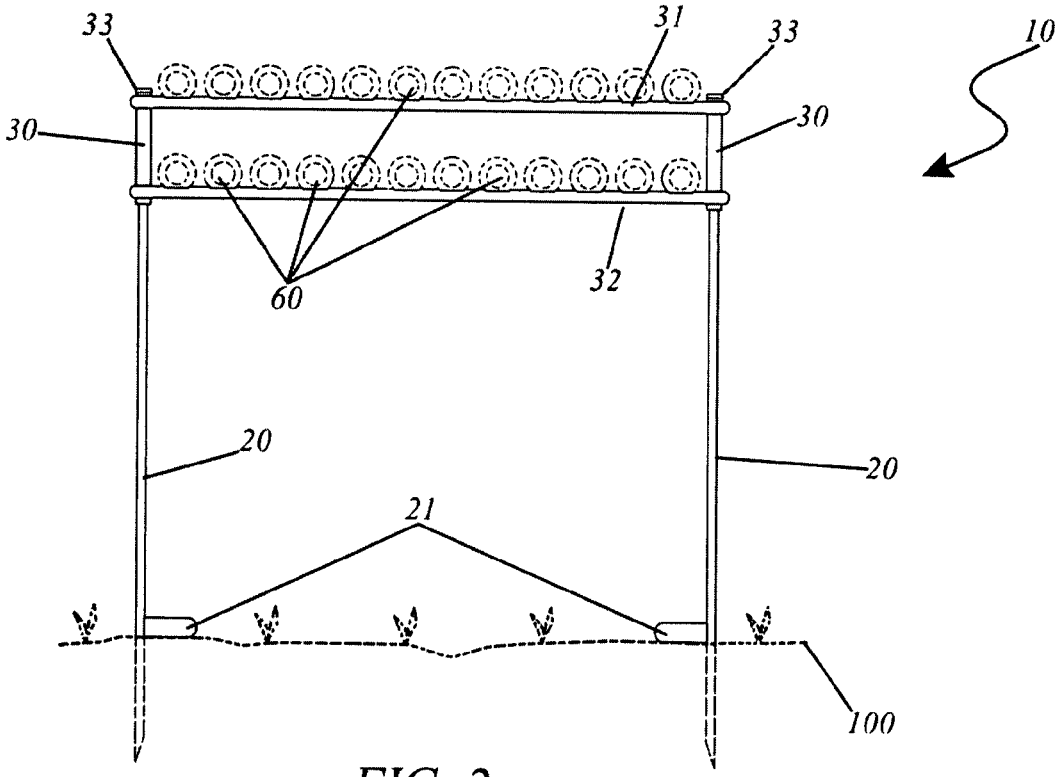
FIG. 2*a* is a front view of a practice targeting system 10 depicting a clay pigeon target 60 usage, according to a preferred embodiment of the present invention.
Figure 2B:
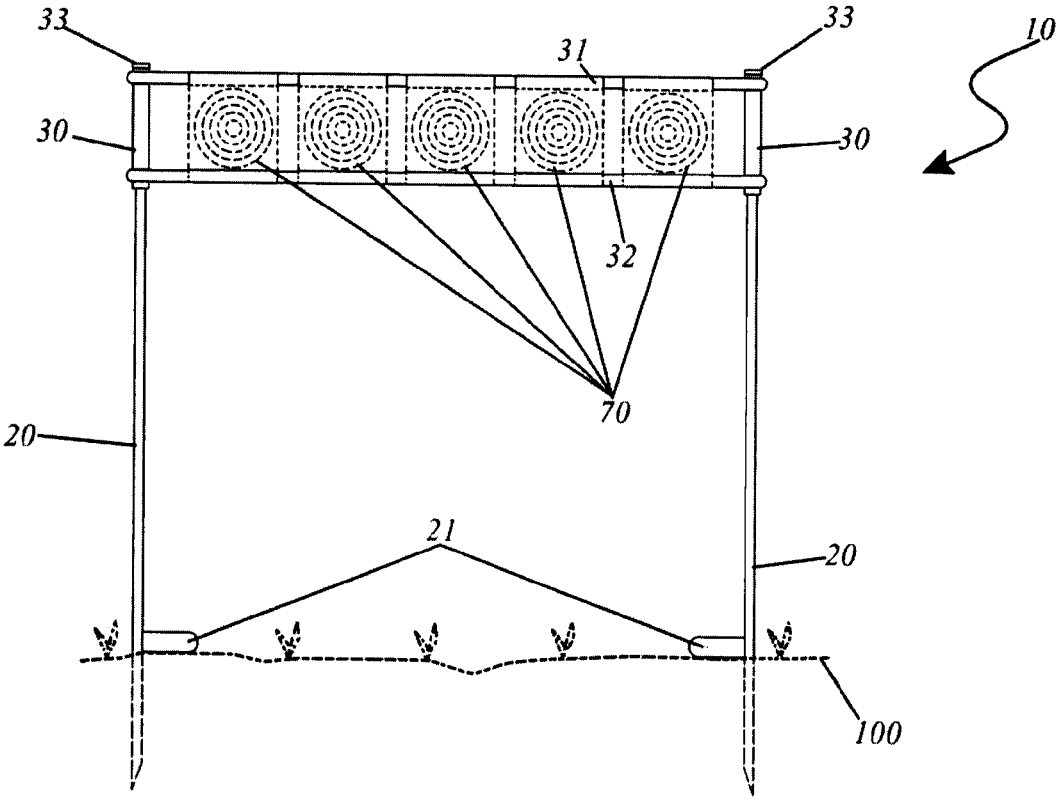
FIG. 2*b* is a front view of a practice targeting system 10 depicting a paper target 70 usage, according to a preferred embodiment of the present invention.

Referring now to FIGS. 2*a* and 2*b*, front views of a practice targeting system 10 depicting a clay pigeon target 60 and paper target 70 usage, respectively, according to the preferred embodiment of the present invention, are disclosed. The system 10 illustrates a loading of a plurality of clay pigeon targets 60 and paper targets as applied to the upper 31 and lower 32 rails of the double rail configuration. The clay pigeon targets 60 are envisioned to rest in a stable fashion thereupon the felt strips 34, thereby preventing sliding or shifting of said clay pigeon targets 60 during target practice. The paper targets 70 are envisioned being supported by both, or a single rail 31, 32 and affixed thereto using adhesive tape, spring clips, or the like.

Figure 3B:
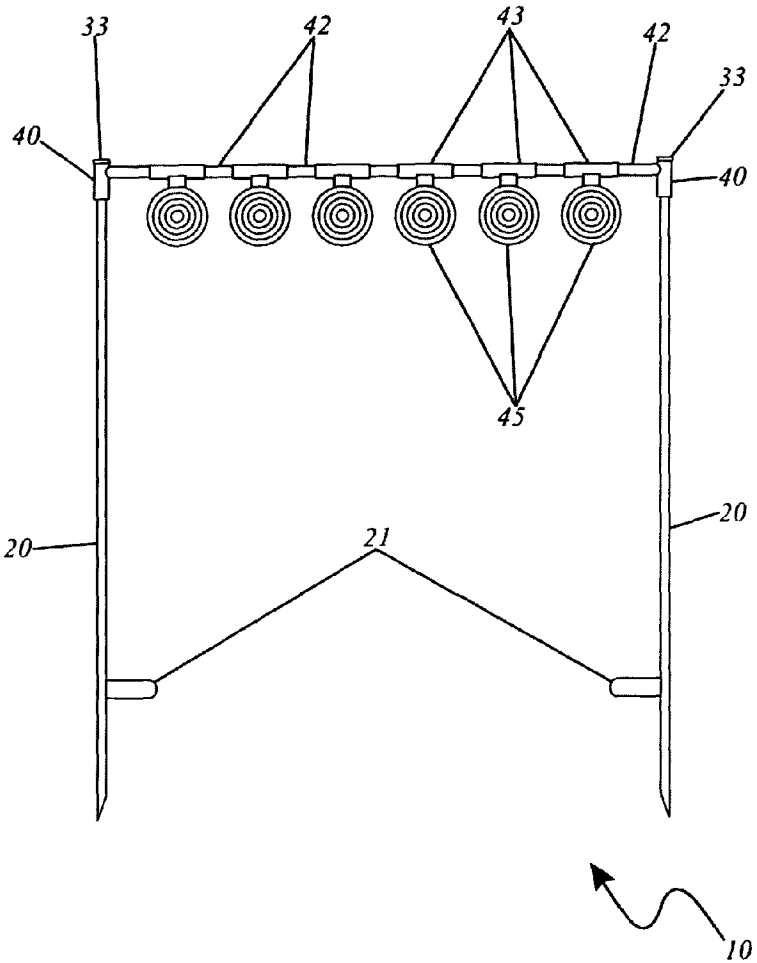
FIG. 3*b* is an assembled view of a practice targeting system 10 depicting a single-tiered beam 42 configuration, according to a preferred embodiment of the present invention; and, FIG. 3*c* is a close-up view of a practice targeting system 10 depicting a swinging target portion 45, according to a preferred embodiment of the present invention.
Figure 3A:
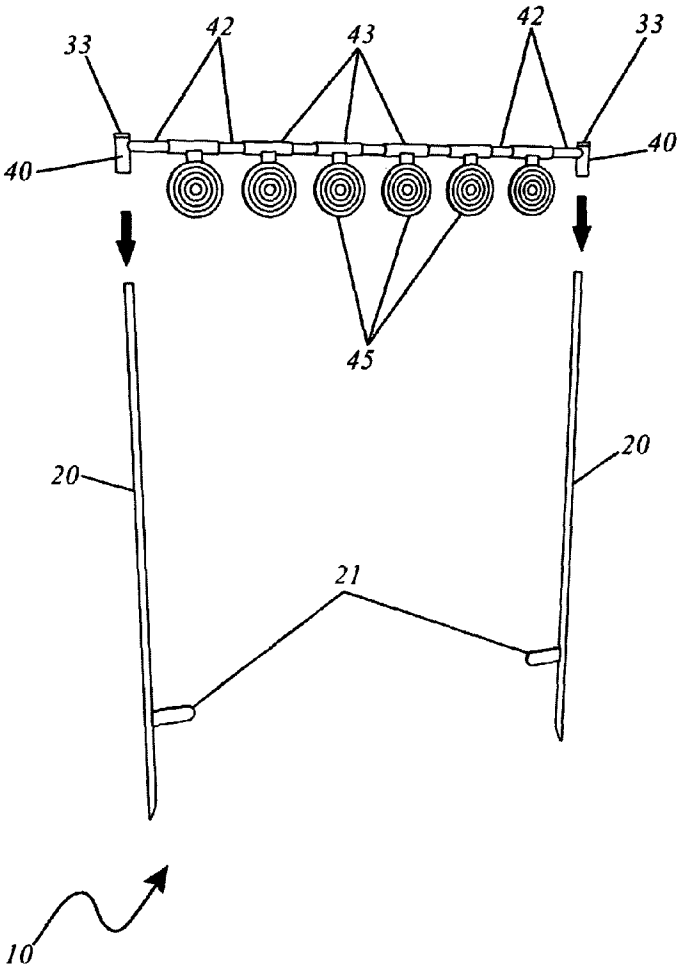
FIG. 3*a* is an exploded view of a practice targeting system 10 depicting a single-tiered beam 42 configuration, according to a preferred embodiment of the present invention.
Figure 3C:
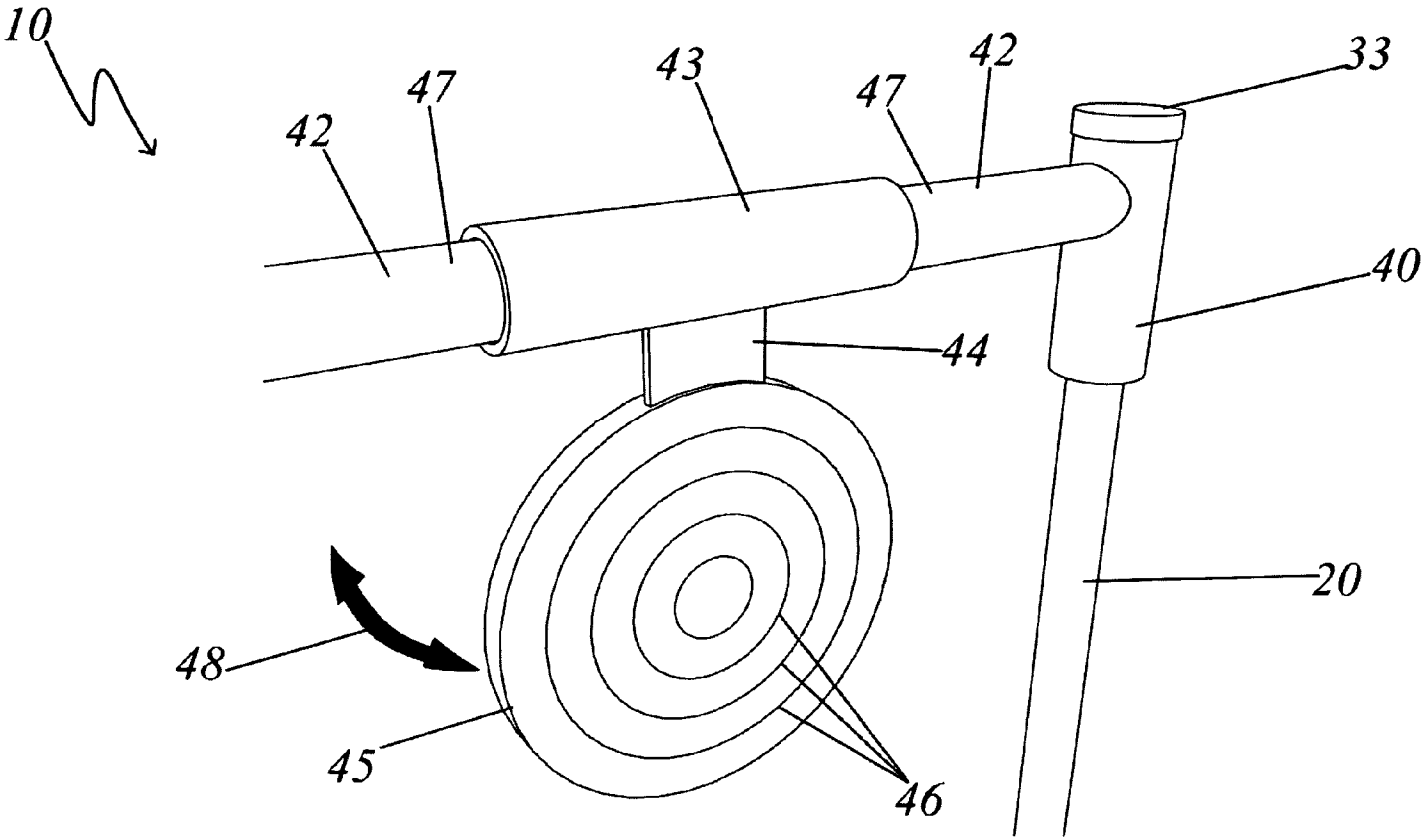

Referring now to FIGS. 3*a*, 3*b*, and 3*c*, exploded, assembled, and close-up views of a practice targeting system 10 depicting a single-tiered beam 42 configuration, according to the preferred embodiment of the present invention, are disclosed. The system 10 comprises a pair of single-tiered tubes 40, a single-tiered beam 42, a plurality of target brackets 43, a plurality of target connectors 44, a plurality of swinging targets 45, a plurality of bulls eyes 46, and a plurality of retaining fasteners 47. The single-tiered target holder as shown here provides an attachment means thereto spinning or swinging targets 45 as well as utilizing paper targets 70 or other hanging target devices in like manner as the double-tiered holder described above. The single-tiered tubes 40 comprise a vertical length of approximately four (4) inches and welded end caps 33 providing a sliding connection means thereto the leg posts 20. The single-tiered tubes 40 comprise similar materials, construction, and function as the double-tiered tubes 30. The single-tiered beam 42 comprises a solid round metal shape being approximately four (4) feet long and approximately one-half (½) to one (1) inch in diameter providing an attachment means at each end thereto the single-tiered tubes 40 using a welding process. The plurality of target brackets 43 comprise tubular elements sized so as to fit slidingly thereupon said single-tiered beam portion 42. The single-tiered beam portion 42 further comprises a plurality of retaining fasteners 47 threadingly inserted therein providing a lateral positioning means thereto said target brackets 43 during use being positioned adjacently thereto said brackets 43. Said fasteners 47 are envisioned to comprise common fasteners such as screws, bolts, rivets, or the like. The target brackets 43 provide an attachment means thereto respective swinging targets 45 via rectangular target connectors 44 extending perpendicularly downward therefrom being welded thereto said target brackets 43 and swinging targets 45 forming a bridging and connecting means thereto. The swinging targets 45 are envisioned to hang freely downward being pivotingly connected thereto the single-tiered beam 42 via the target brackets 43. In use, a bullet or pellet fired therefrom a small caliber firearm makes contact with the swinging target 45 producing a resultant spinning or swinging motion 48 rotatingly about an axis defined thereby the single-tiered beam 42. The swinging target 45 further comprises a bulls-eye 46 located thereupon a front surface, thereby aiding a user while taking aim during target practice and providing immediate marksmanship accuracy and consistency feedback to a user. The bulls-eye 46 is envisioned to provide an optically contrasting pattern of circumscribed circles being applied thereto using etching, printing, decals, or the like. The swinging targets 45 are envisioned being made of durable metal materials approximately one-eighth (⅛) to one-half (½) inch thick, thereby producing a desired motion 48 based upon a selected firearm type and a user's preference. It is further envisioned that the retaining fasteners 47 may be removed therefrom the single-tiered beam 42 allowing the target brackets 43 to be slidingly moved in a lateral direction and repositioned so as to utilize an unobstructed length of the single-tiered beam 42 for hanging paper targets 70 or other target devices in a similar fashion as the aforementioned double-tiered configuration based upon a user's preference.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed and utilized as indicated in FIGS. 1, 2*a*, 2*b*, and 3*b*.

The method of installing and utilizing the double-tiered configuration of the system 10 may be achieved by performing the following steps: inserting the two (2) leg posts 20 therein respective double-tiered tubes 30; sliding said leg posts 20 therein said tubes 30 until making a stopping contact therewith the welded end caps 33; manually driving the angularly cut bottom end portions of the leg posts 20 therein a grade surface 100 by pressing downward on the two (2) foot pegs 21 using one's foot until said foot pegs 21 are even with a grade surface 100; loading one (1) or more clay pigeon targets 60 onto the upper rail 31 and/or lower rail 32; affixing one (1) or more paper target 70 or other attachable target device thereto said rails 31, 32 using adhesive tape or other suitable fastening method; positioning a user at a specific desired distance therefrom the system 10; practicing one's marksmanship using a small caliber firearm in an expected manner.

The method of installing and utilizing the single-tiered configuration of the system 10 may be achieved by performing the following steps: inserting the two (2) leg posts 20 therein the single-tiered tubes 40; sliding said leg posts 20 therein said tubes 40 until making a stopping contact therewith the welded end caps 33; manually driving the angularly cut bottom end portions of the leg posts 20 therein a grade surface 100 by pressing downward on the two (2) foot pegs 21 using one's foot until said foot pegs 21 are even with a grade surface 100; positioning a user at a specific desired distance therefrom the system 10; utilizing the swinging targets 45 while taking aim during normal target practice using a small caliber firearm; producing a spinning or swinging motion 48 of the swinging target 45 upon impact of a bullet or pellet therefrom a small caliber firearm; and, benefiting from use of the targeting system 10 providing an effective training aid for a user using small caliber handguns and rifles during target practice in a manner that is safe and efficient.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A target training device for marksmanship target practice comprises:

a first and a second leg post each for insertion into a ground surface, each further comprising:

a solid rod of a height comprising approximately forty-eight (48) inches and having an angular bottom portion; and, a foot peg affixed at a location approximately twelve (12) inches from said bottom portion, further comprising a rectangular-shaped metal appendage extending approximately six (6) inches perpendicularly from each said first and second leg post;

a double-tiered target holder for removable attachment to a top portion of each said first and second leg post, further comprising:

a first hollow tube with a hollow bottom end and a first end cap attached to a top end;

a second hollow tube with a hollow bottom end a second end cap attached to a top end;

an upper rail affixed to an upper portion of each said first and second tube and further comprising:

an upper pair of rods spaced approximately one (1) inch apart in a parallel arrangement;

an upper plurality of stiffener bars spaced at regular intervals along and affixed to said pair of rods; and, an upper first and second end portion for wrapping around said first and second tube and affixed thereto;

a lower rail affixed to a lower portion of each said first and second tube and further comprising:

a lower pair of rods spaced approximately one (1) inch apart in a parallel arrangement;

a lower plurality of stiffener bars spaced at regular intervals along and affixed to said pair of rods; and, a lower first and second end portion for wrapping around said first and second tube and affixed thereto;

wherein said bottom portion aids in piercing said ground surface when inserted therein;

wherein each said foot peg aids in inserting said first and second leg post into said ground surface:

wherein said bottom end of each said first and second tubes comprises a particularly sized inside diameter to correspondingly slide over said first and second leg posts;

wherein said upper rail and lower rail span a width between said first and second tube;

wherein said upper and lower plurality of stiffener bars aid in maintaining said parallel arrangement of said upper and lower pair of rods, respectively;

wherein said double-tiered configuration is designed to hold two (2) rows of said plurality of targets; and, wherein a plurality of interchangeable targets are supported thereon said target holder of said device.

2. The device of claim 1, wherein said upper and lower rails comprise said width of approximately forty-eight (48) inches and are attached to said first and second tubes at a distance of approximately ten (10) inches.

3. The device of claim 2, wherein a plurality of self-adhesive felt strips are located thereon interior facing surfaces of said upper and lower pair of rods;

wherein said plurality of felt strips aid in keeping said plurality of targets in an upright position and prevent sliding thereof.

4. The device of claim 3, wherein said plurality of targets comprises clay pigeons.

5. The device of claim 3, wherein said plurality of targets comprises paper targets.

* * * * *